United States Patent [19]

Turner

[11] Patent Number: 4,641,839

[45] Date of Patent: Feb. 10, 1987

[54] ROLLER-BALL STRUCTURE

[76] Inventor: Arthur A. Turner, 8110 SW. 72nd Ave., B-5, Miami, Fla. 33143

[21] Appl. No.: 763,864

[22] Filed: Aug. 9, 1985

[51] Int. Cl.[4] ..... A63B 71/00; A63B 43/02

[52] U.S. Cl. ..... 273/128 A; 273/58 F; 273/64

[58] Field of Search ..... 273/128 R, 128 A, 63 R, 273/63 D, 63 E, 128 CS, 58 F, 64

[56] References Cited

U.S. PATENT DOCUMENTS 1,371,704 3/1921 Miller ..... 273/128 CS

*Primary Examiner*—George J. Marlo

*Attorney, Agent, or Firm*—John C. Malloy

[57] ABSTRACT

A roller-ball assembly including a spherically shaped ball but comprising a multi-piece construction including a substantially centrally disposed roller element and two ball segments preferably disposed at opposite ends or sides of said roller element and fixedly secured to one another or to said roller ball structure generally such that the roller element is movable relative to said ball segments. A rolling surface is collectively defined by the external surfaces of the roller element and said ball segments wherein collectively the external surfaces define an external spherical configuration of the roller ball assembly. The external or rolling surface of the roller ball, due to its multi-piece construction, may be defined by one or more external surfaces of said roller element and/or ball segments concurrently engaging a supporting surface over which the roller ball travels. Depending upon the combination of fixed and movable surfaces engaging the supporting surface, the path of travel of said roller ball is determined and may vary greatly.

12 Claims, 11 Drawing Figures

ROLLER-BALL STRUCTURE

BACKGROUND OF THE INVENTION

1. Field of the Invention

A ball structure primarily designed to be rolled across or over a supporting surface and being particularly structured to be rolled along a preselected path of travel which may vary greatly dependent upon which portions of the external spherical surface of the ball structure independently and/or concurrently engages the supporting surface over which the ball travels. The ball structure may be used by itself or in combination with a variety of games as an entertainment device.

2. Description of the Prior Art

Toys, games, and like entertainment devices have been in existence in one form or another for literally hundreds of years. Certain conventional components have found continued and wide acceptance throughout these years as evidences by their continued use in a variety of game assemblies. The common spherical ball is one of these conventional and commonly used game components which finds a wide range of categories in which it serves as a primary entertainment device.

While the ball has been used in numerous game assemblies, it is also a device which provides entertainment and gives pleasure in and of itself without accompanying game parapharnalia. Certain existing United States patents are generally representative of a variety of structures and functions in which a spherically shaped ball serves as the primary component or structure. Such patents include Turnbull, U.S. Pat. No. 1,847.414 and U.S. Pat. No. 2,454,492; Huff, U.S. Pat. No. 2,666,276; Lhotka, U.S. Pat. No. 2,935,321; and Gilbert, U.S. Pat. No. 2,944,823. All of these devices incorporate a spherically shaped ball element or structure as a primary or auxiliary component in what may be referred to as a toy or entertainment device.

Even in light of the wide variety of structures known and available in the prior art, as evidenced by the above-referenced patents, there appears to be a never-ending need for new entertainment devices, game assemblies or primary components, such as a ball, to amuse both young and old alike.

Accordingly, a novel roller-ball assembly or structure capable of traveling along a preselected path of travel, which may vary drastically, due to the structure of the roller-ball assembly and the manner it was applied to travel over a supporting surface, would appear to receive acceptance by players of all ages.

SUMMARY OF THE INVENTION

This invention relates to a roller-ball structure of the type capable of providing entertainment when used by itself or in combination with a variety of games. The roller-ball structure of the present invention is structured to include a multi-piece construction including one substantially centrally located roller element which is maintained in rotational motion relative to the remaining portions of the roller-ball structure. Such remaining portions include a plurality of, and preferably two, ball segments which are located on opposing sides of the roller element and fixed relative to the rotational motion of the roller element.

The roller element and the ball segments are cooperatively structured to respectively include a substantially partially or semi-spherical external surface configuration. Accordingly, collectively the external surfaces of the roller element and ball segments define a rolling or contact surface of the roller-ball such that it may roll continuously over a supporting surface when properly propelled. As set forth above, the roller element and accordingly the external semi-spherical surface thereof is maintained in substantially constant rotational movement relative to the ball segments and their respective external surfaces. Therefore, the roller-ball structure of the present invention is constructed to include a rolling surface defined by the plurality of external surfaces of the elements of the roller-ball structure, as set forth above, and dependent upon which of these surfaces independently and/or concurrently engage the supporting surface over which the ball structure travels, the path of travel of the roller-ball will be determined.

In a preferred embodiment, to be described in greater detail hereinafter, the roller-ball structure is used in combination with a drive means including some type of support platform and a driving element having an externally disposed, substantially continuous exterior surface extending outwardly in exposed relation to its support platform. The drive means may be activated by hand-powered, mechanical movement or by a drive motor, such as an electric motor or the like, so as to impart continuous rotational movement to the drive element. In operation, a user or player grips both of the ball segments of the roller-ball structure without touching the roller element. The outer surfaoe of the roller element is then applied to the continuously moving surface of the drive element so as to impart rotational motion to the roller element. While the rotation of the roller element is maintained, the rollerball structure is applied to the supporting surface, in a preselected fashion causing its travel therealong.

As will be pointed out in greater detail hereinafter, depending upon which surface or surfaces of the roller element and ball segments engage the supporting surface over which the roller-ball travels, the path of travel of the roller-ball will be determined and may vary to include a straight line, curved or return path configuration.

While the present invention is herein described primarily with reference to the external surface of the roller-ball being spherical, it should be noted that other shapes of the roller-ball are contemplated. Such shapes include but are not limited to cylindrical, oval, partially conical, etc. An important feature of the present invention is, however, that the collective outer or external surfaces of the roller element as well as the ball segments collectively define the rolling or contact, external, surface of the roller-ball which independently or concurrently movably engage the supporting surface over which the roller-ball travels. Further, the roller element is substantially centrally located relative to oppositely disposed and spaced apart ball segments a set forth above.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
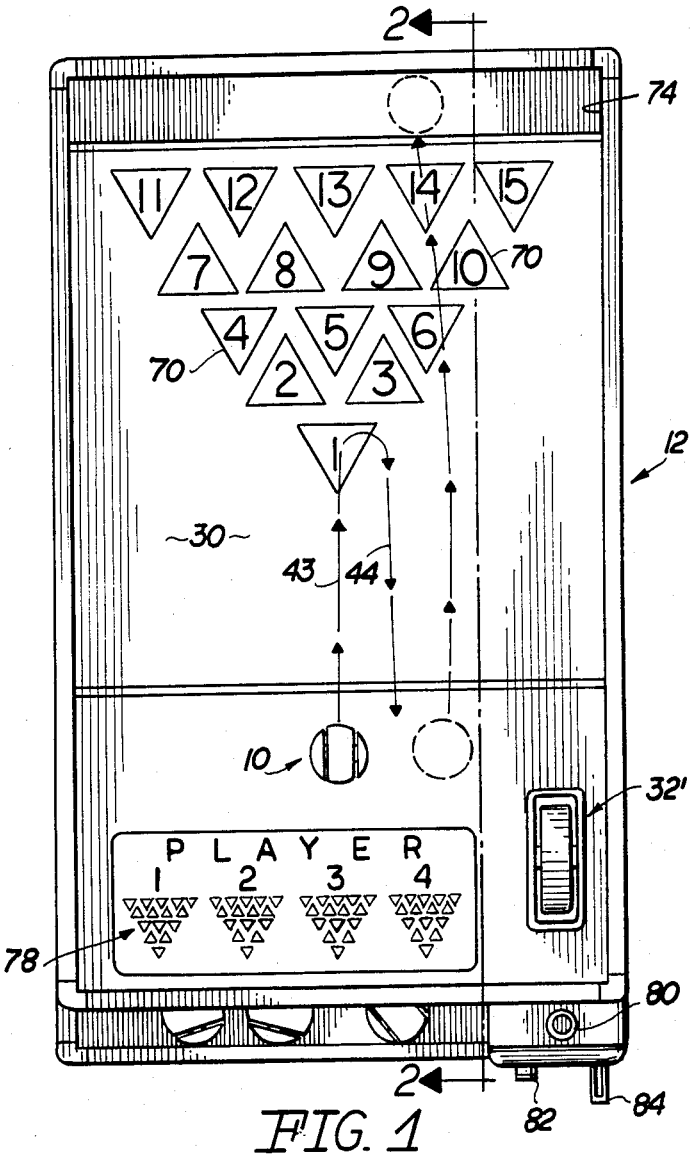
FIG. 1 is a top plan view of a game assembly with which the roller-ball structure of the present invention may be used.

With reference to FIGS. 1 through 6, the present invention is directed towards a roller-ball structure generally indicated as 10 which can be used for entertainment and pleasure in and of itself or in combination with a variety of game assemblies or structures such as that indicated generally in FIG. 1 as 12. The game assembly 12 will be explained in greater detail hereinafter as being representative of a number of different type of structures which one or more of the roller-ball structures 10 can be used. However, with primary reference to FIGS. 3, 4 and 5, the roller-ball structure 10 comprises a substantially centrally located roller element 14. In addition, the roller ball structure 10 further includes a plurality of ball segments and preferably two of such segments 16 and 18. The roller element 14 is structured to be rotatable relative to the remainder of the roller-ball structure 10 and specifically rotatable relative to ball segments 16 and 18. Accordingly, one embodiment of the present invention includes the ball segments 16 and 18 being fixedly attached to one another as by a centrally disposed shaft or axle 20. Shaft 20, in the embodiment shown in FIGS. 4 and 5, has a substantially elongated configuration so as to pass through the center of the roller element 14 and thereby define an axis of rotation thereof. The opposite ends of the shaft 20 as at 21 and 22 are fixedly secured to the respectively positioned ball segments 16 and 18.

Figure 5:
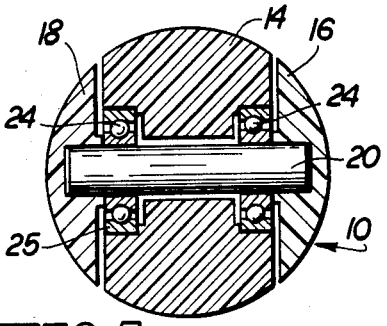
FIG. 5 is a sectional view along line 5—5 of FIG. 3.
Figure 2:
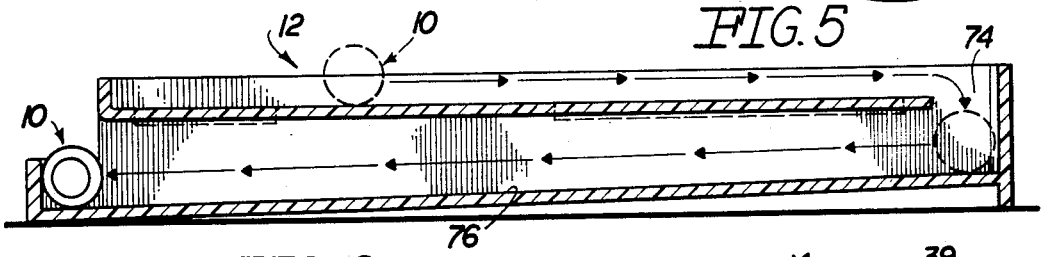
FIG. 2 is a sectional view along line 2—2 of FIG. 1.

Also with reference to FIG. 5, a bearing assembly including a plurality of ball bearings 24 mounted in appropriately positioned races 25 wherein the bearing assemblies are positioned and structured to provide relative rotation of the roller element 14 about the shaft 20 and relative to the ball segments 16 and 18.

Figure 3:
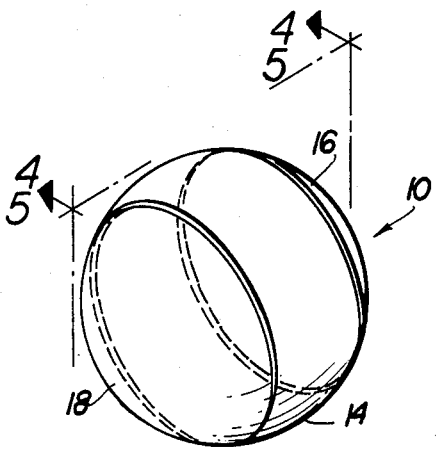
FIG. 3 is an isometric view of the roller-ball structure of the present invention.
Figure 4:
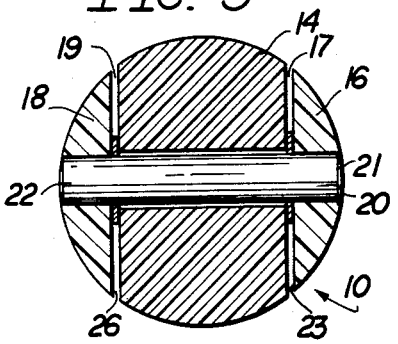
FIG. 4 is a sectional view along line 4—4 of FIG. 3.

In the embodiment shown in FIGS. 3, 4 and 5, the ball segments 16 and 18 effectively serve as end caps in that they are positioned in spaced relation to but substantially adjacent oppositely disposed inner surfaces 17 and 19 respectively of the roller element 14. As is clearly shown, the correspondingly positioned inner surfaces 23 and 26 of the respective ball segments 16 and 18 are substantially planar in configuration and disposed parallel to one another. Similarly, the inner surfaces 17 and 19 of roller segment 14 are planar and positioned parallel to one another and to the respectively positioned inner surfaces 23 and 26 of the ball segments 16 and 18.

An important feature of the present invention is the multi-piece construction of the roller-ball structure 10 and also the multi-piece construction of th substantially spherically configured outer surface of the roller-ball structure 10. This substantially spherical outer surface of roller-ball structure 10 is defined by the partially spherical or semi-spherical surfaces of the roller element 14 as well as the ball segments 16 and 18. Accordingly, the collective external surfaces of the roller element 14 and the ball segments 16 and 18 define the spherical outer surface of the roller-ball structure 10.

As will be explained in greater detail hereinafter and specifically with relation to FIGS. 7 and 8, the fact that the external surface of the roller element 14 is maintained in constant motion while the external surfaces of the ball segments 16 and 18 is maintained in a fixed relation thereto, provides a predetermined path of travel of the roller-ball 10 as it travels over a given support surface 30.

Figure 6:
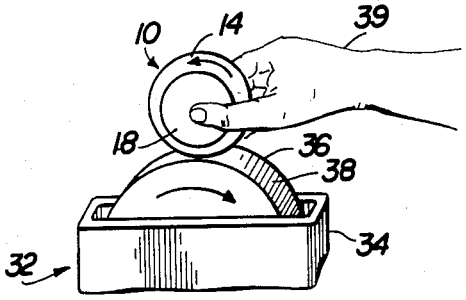
FIG. 6 is an isometric view showing the roller-ball structure of the present inventio used in combination with a drive element.

With regard to FIG. 6, the ball structure 10 is constructed to be used in combination with a drive means generally indicated as 32. This drive means includes a support platform 34 and a drive element 36 having a substantially continuously configured outer and exposed surface 38. The structure of the drive means (not shown in detail) is such that the drive element may be maintained in substantially constant rotation as indicated by the appropriately positioned directional arrow in FIG. 6. This constant rotation in turn of course causes the continuous surface 38 to be maintained in constant motion. Accordingly, when a player grasps the roller-ball structure 10 with his hand as at 39, such that the ball segments 16 and 18 are grasped while the roller element 14 is untouched, rotational motion can also be imparted directly to the roller element 14. This rotational motion of roller element 14 is imparted when the external surface of the roller element is brought into engagement with the continuous surface 38 of the drive means 32. The bearing assembly (FIG. 5) is such as to allow continuous rotational motion of the roller element 14 relative to the ball segments 16 and 18 for some period of time. Once this rotational movement is maintained, the ball structure is then applied to a supporting surface 30 and/or 30′ (FIGS. 7, 8 & 1) and the ball is allowed to travel therealong in any of a number of preselected paths of travel. Again with reference to FIG. 6, the drive element 36 may be driven by hand, through mechanical linkage or the like or may be powered by an electric motor as will be explained in greater detail with reference to FIG. 1. Also it should be noted, that the drive means 32 can be used in and of itself (FIG. 6) or in combination with a game assembly 12 as shown in FIG. 1.

Throughout, the present invention has been described with reference to a spherical outer surface formed by the collective partially spherical or semi-spherical outer surfaces of the roller element 14 and ball segments 16 and 18. However, it should be noted that the term spherical is not meant to include a true or geometrically accurate sphere. More specifically, the terms spherical and semispherical or partially spherical are meant to include an outer surface having a curvilinear cross-sectional configuration. The collective outer curved or semi-spherical surfaces of the roller element 14 and ball segments 16 and 18 could be varied to the extent that the roller-ball would have a substantially oval and/or cylindrical configuration as well as a variety of other configurations not specifically listed herein.

Figure 9:
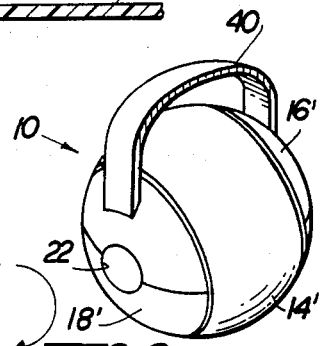
FIGS. 9, 10 and 11 are all isometric views of the roller ball structure of the present invention with auxiliary mounting thereon.
Figure 10:
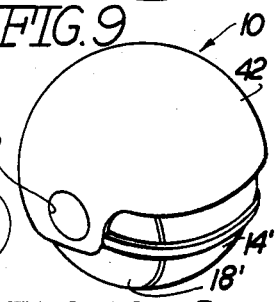
Figure 11:
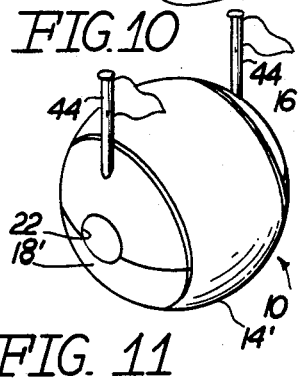

With reference to FIGS. 9, 10 and 11, auxiliary mountings may be applied to the roller-ball structure 10 for purposes of utility for gripping such as handle as well as providing decoration or "dress" as the structure representing a football helmet 42 or banners or flag posts 44. With each of the auxiliary mountings of FIGS. 9, 10 and 11, the structures 40, 42 and 44 are secured to the end segments 16' and 18' so as to be relatively stationary therewith while allowing the rotational motion of the roller element 14' to be maintained. Also, dependent upon the embodiment of the particular roller-ball structure utilized, the end portions 22 of the shaft may extend through one of the exposed surfaces of the ball segments 16' and/or 18' as shown. Another structural feature of the embodiments of FIGS. 9, 10 and 11 may include the addition of a weighted struture as at 18' to serve as ballast so as to maintain the ball segmens 16' and 18' in a relatively secure, fixed position to the rotating roller element 14' thereby insuring that the auxiliary mountings 40, 42 and 44 will be maintained in an upright orientation as pictured in FIGS. 9, 10 and 11. It should be apparent that other auxiliary mountings may be utilized other than the specific design, shape or configuration as that represented by auxiliary mountings 40, 42 and 44.

Figure 7:
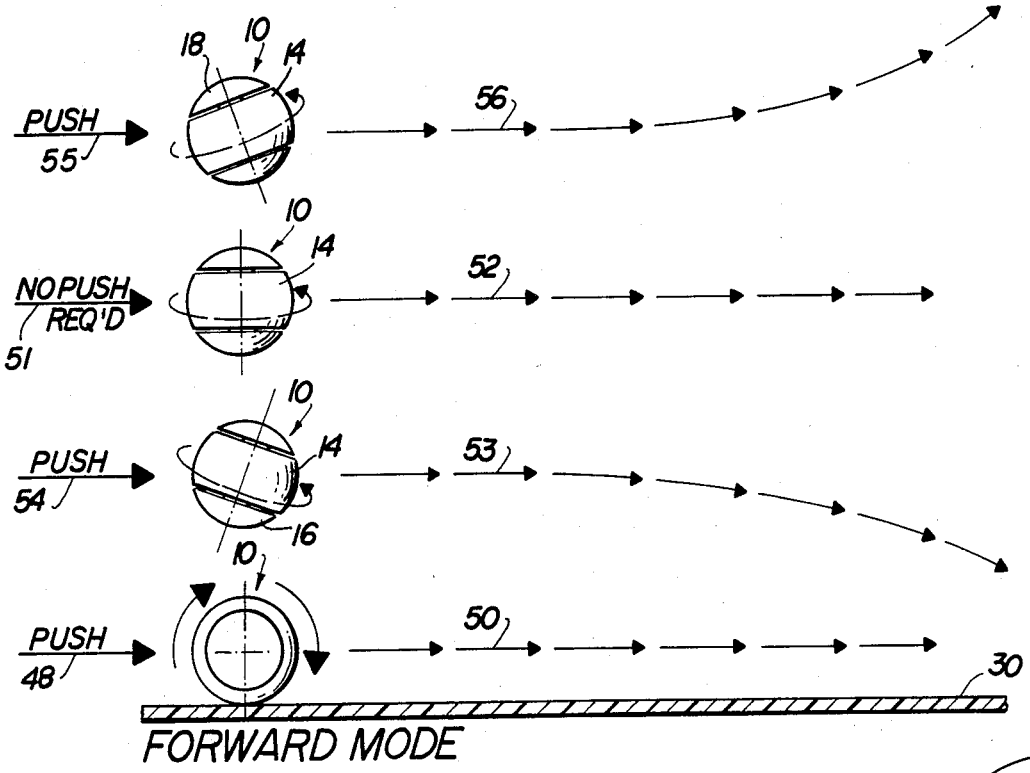
FIG. 7 is a substantially schematic representation of the configuration of the path of travel that the roller-ball structure of the present invention may take in a forward mode.
Figure 8:
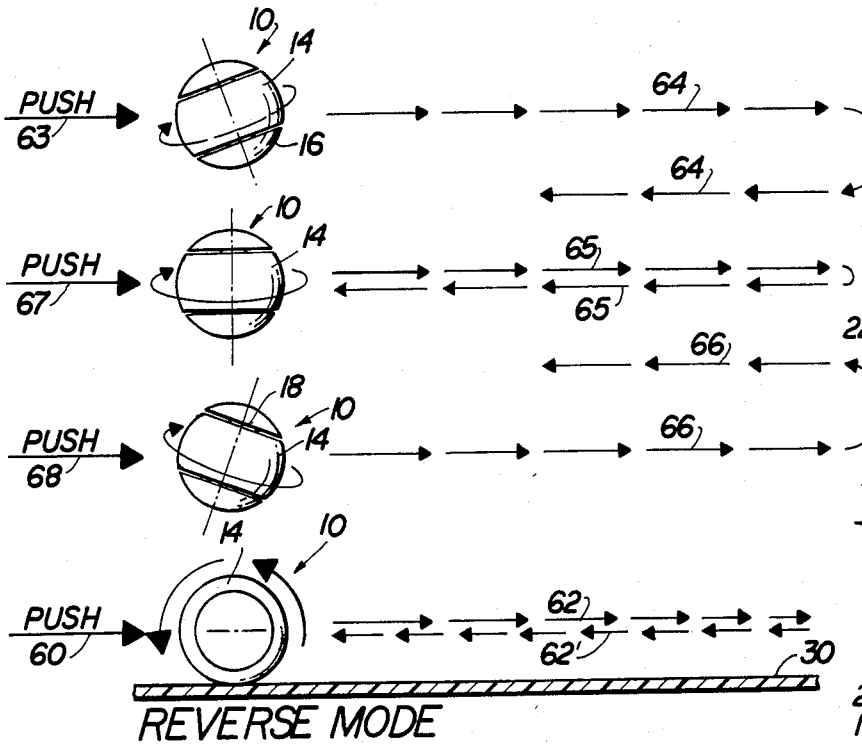
FIG. 8 is a substantially schematic representation of the configuration of the path of travel of the roller-ball structure of the present invention may take when traveling in a reverse mode.

With reference to FIGS. 7 and 8, it should be apparent, from an understanding of the structure of the roller-ball 10 that it can readily travel in either a forward mode (FIG. 7) or a reverse mode (FIG. 8) such as when the player desires the ball to be returned to him as indicated by the path of travel 43 (FIG. 1) or when it is desired that the path of travel will be substantially linear and continuously away from the player as indicated by the path of travel 44 (FIG. 1). Also as set forth above, the direction of the path of travel may vary dependent upon which external surfaces of the roller element 14 and/or ball segments 16 and/or 18 independently or concurrently engage the supporting surface 30.

With reference to FIG. 7, when the ball structure 10 is desired to travel in a forward mode a push 48 is delivered to the roller-ball while the roller element 14 is maintained in its continuous rotation, as set forth above. When so accomplished, the roller-ball 10 will travel forwardly as indicated by path of travel 50. When it is desired that the roller-ball 10 travel in a path of travel which is straight line and in a forward mode, no push is required as at 51 and only the roller element 14 has its external surface engage the supporting surface 30. As a result, a forward straight line path of travel 52 occurs.

Similarly, when it is desired to turn to the right or left, a forward push is imparted to the roller-ball as at 54 and 55 respectively. The difference being that the right-hand curve occurs when the external surface of the roller element 14 and the ball segment 16 concurrently engages supporting surface 30. Similarly, when the ball segment 18 and the roller element 14 concurrently engage the supporting surface 30, the left-hand curve 56 defines the preselected path of travel of the roller-ball 10.

Similarly, with regard to FIG. 8, when it is desired to impart a reversing motion or mode to the ball structure 10, a push 60 is imparted in a direction substantially opposite to the direction of rotation of the roller element 14 as indicated in FIG. 8. Accordingly, the reaction of the spherical external surface of the roller-ball 10 with the supporting surface 30 causes the roller-ball 10 to travel outwardly in a first forward direction as indicated by the path of travel 62 and then rearwardly in a reverse direction as indicated by the path of travel 62'. Similarly, when it is desired that the roller-ball 10 return in a preselected path of travel including a right-hand turn 64, a push 63 is impated to the roller-ball 10 concurrently to engaging both the external surfaces of the roller element 14 and the ball segment 16 as shown. A forward push 67 is imparted to roller ball 10 to get a straight line forward and reverse path of travel 65 while only the external surface of the roller element 14 engages the supporting surface 30. Finally, when a path of travel 66 including a left-hand return is desired, a push 68 is imparted to the roller-ball 10 while concurrently the external surfaces of the roller element 14 and the ball segment 18 are allowed to engage the supporting surface 30.

By virtue of the above, it is readily seen that the player can control the direction and/or configuration of the path of travel over any given supporting surface 30 and/or 30' (see FIGS. 7, 8 and 1).

As shown in FIG. 1, both paths of travel 43 and 44 may be desirable when utilizing a substantially target type game including a plurality of targets 70 which may be built into the plane of the supporting surface 30' but which may be connected to pressure type switches such that when the ball structure 10 passes over and/or engages one of the targets 70, a switch is activated causing its illumination (or darkening). Similarly, if the ball goes too far, a ball return slot 74 is provided to return the ball 10 (see FIG. 2) along a slanted return channel 76 as shown. A score type display 78 can be provided as well as a drive means 32' activated by a control switch 80 which also may include a control or operating switch for the entire game assembly 82 and a coin receiving slot 84 such as when the game assembly 12 is used for a commercial enterprise.

Again, it should be emphasized that the game assembly 12 is only representative of a large variety of games with which the roller-ball structure 10 can be utilized.

What is claimed is:

1. A roller-ball structure of the type designed to travel over a supporting surface, said structure comprising:

(a) a roller element rotatably mounted on a centrally disposed shaft having a longitudinal axis which defines an axis of rotation of said roller element, (b) two ball segments each fixedly secured to said shaft on opposite sides of said roller element, said roller element movable relative to said two ball segments, (c) said roller element and each of said ball segments respectively comprising an external surface having a semispherical configuration, (d) said external surface of said roller element being rotatably movable relative to said external surfaces of said ball segments and said external surfaces of said roller element and ball segments collectively defining a substantially continuous spherical configuration of said roller ball structure, (e) a support engaging, rolling surface defined by said semi-spherical external surfaces of said roller element and said ball segments, and (f) said external surfaces of said ball segments being spaced from said external surface of said roller element but closely adjacent thereto to allow concurrent engagement of said external surface of said roller element and said external surface of either of said ball segments.

2. A structure as in claim 1 further comprising gripping means fixedly secured to said ball segments for the handling of said roller-ball structure, said roller element rotatably movable relative to said gripping means.

3. An assembly as in claim 2 further comprising ballast means mounted on said ball segments and disposed for maintenance of said gripping means in an upright orientation.

4. A structure as in claim 2 wherein said gripping means comprises a shell surrounding a portion of the external surfaces of said ball segments and said roller element in at least partially covering relation thereto.

5. A structure as in claim 2 wherein said gripping means comprises a handle element.

6. A structure as in claim 2 wherein said gripping means comprises a banner structure each fixedly secured to and extending outwardly from a different one of said ball segments.

7. A structure as in claim 1 wherein each of said ball segments comprise a substantially planar inner surface disposed in spaced and adjacent relation to a correspondingly positioned inner surface of said roller element.

8. A structure as in claim 7 wherein each of said inner surfaces of said roller element comprises a substantially planar configuration disposed in substantially parallel relation to said correspondingly positioned inner surfaces of said ball segments.

9. A structure as in claim 8 wherein said inner surfaces of said roller element are disposed in substantially parallel relation to one another.

10. A structure as in claim 1 further comprising bearing means movably interconnecting said roller element to said shaft for rotation of said roller element relative to said ball segments.

11. A structure as in claim 1 in combination with a drive means for imparting rotational motion to said roller element, said drive means comprising a support platform, a driving element rotatably mounted on said support platform and structured to include a substantially continuously driving surface extending outwardly from said support platform in exposed disposition for continuous driving engagement with said external surface of said roller element.

12. A structure as in claim 11 wherein said drive means further comprises a driving motor interconnected to said driving element for continuous rotation thereof upon activation of said driving motor.

* * * * *